US008123397B2

(12) United States Patent
Baumfalk et al.

(10) Patent No.: US 8,123,397 B2
(45) **Date of Patent: *Feb. 28, 2012**

(54) DISPOSABLE CONTAINER HAVING SENSOR MOUNTS SEALED TO THE CONTAINER AND SENSORS IN THE SENSOR MOUNTS FOR MEASURING AT LEAST ONE PARAMETER OF MEDIA IN THE CONTAINER

(75) Inventors: Reinhard Baumfalk, Göttingen (DE); Oscar-Werner Reif, Hanover (DE); Stefan Obermann, Adelebsen-Erbsen (DE); Dieter Schmidt, Rosdorf (DE)

(73) Assignee: Sartorius Stedim Biotech GmbH (DE)

( * ) Notice: Subject to any disclaimer, the term of this patent is extended or adjusted under 35 U.S.C. 154(b) by 334 days.

This patent is subject to a terminal disclaimer.

(21) Appl. No.: 11/643,548

(22) Filed: Dec. 21, 2006

(65) Prior Publication Data

US 2007/0159920 A1 Jul. 12, 2007

(30) Foreign Application Priority Data

Jan. 11, 2006 (DE) ..... 10 2006 001 623

(51) Int. Cl.
*B01F 15/04* (2006.01)

(52) U.S. Cl. ..... 366/152.4; 366/152.1; 366/314

(58) Field of Classification Search ..... 366/142, 366/151.1–153.1, 273–274, 314, 331; 137/92, 137/93, 551, 552; 604/403, 404, 408, 413; 435/302.1, 303.3; 416/3; 464/29; 403/DIG. 1
See application file for complete search history.

(56) References Cited

U.S. PATENT DOCUMENTS

| | | | | | |
|---|---|---|---|---|---|
| 2,856,930 | A | * | 10/1958 | Huyck et al. | 604/404 |
| 3,179,380 | A | * | 4/1965 | Drayer | 366/178.3 |
| 3,378,245 | A | * | 4/1968 | Frank | 425/4 R |
| 3,591,147 | A | * | 7/1971 | Anderson et al. | 366/142 |
| 3,951,386 | A | * | 4/1976 | Small et al. | 366/142 |
| 4,322,226 | A | * | 3/1982 | Hudec | 95/266 |
| 4,332,906 | A | * | 6/1982 | Taylor | 435/297.1 |
| 4,640,128 | A | * | 2/1987 | Lewis | 73/866.5 |
| 4,649,118 | A | * | 3/1987 | Anderson | 435/297.3 |
| 4,711,582 | A | * | 12/1987 | Kennedy | 366/279 |
| 4,788,851 | A | * | 12/1988 | Brault | 73/49.2 |
| 4,803,365 | A | * | 2/1989 | Krause et al. | 250/461.2 |
| 5,224,373 | A | * | 7/1993 | Williams et al. | 73/29.02 |
| 5,260,692 | A | * | 11/1993 | Claren | 340/614 |
| 5,487,980 | A | * | 1/1996 | Swartz | 435/29 |
| 5,501,971 | A | * | 3/1996 | Freedman et al. | 435/393 |

(Continued)

FOREIGN PATENT DOCUMENTS

DE 3443911 A1 * 6/1986

(Continued)

*Primary Examiner* — Charles E Cooley
(74) *Attorney, Agent, or Firm* — Gerald E. Hespos; Michael J. Porco

(57) ABSTRACT

A disposable container is provided for mixing media. The container has at least one closable opening for introducing and/or removing media and has sensor mounts at spaced apart locations on the wall of the container. Each sensor mount has a front surface facing into the container and a rear surface sealed against the wall of the container. Sensors are embedded in the respective sensor mounts at positions adjacent the front surfaces. The sensors measure at least one specified parameter of the media at spaced apart locations in the container. The seals between the rear surfaces of the sensor mounts and the wall of the container ensure sterility for the media in the container.

19 Claims, 5 Drawing Sheets

U.S. PATENT DOCUMENTS 5,533,804 A * 7/1996 Larsson et al. ..... 366/274
5,863,715 A * 1/1999 Rajotte et al. ..... 435/1.3
5,888,805 A * 3/1999 Endo et al. ..... 435/287.1
6,065,865 A * 5/2000 Eyraud et al. ..... 366/273
6,149,295 A * 11/2000 Volkmer et al. ..... 366/142
6,190,913 B1 * 2/2001 Singh ..... 435/394
6,265,495 B1 * 7/2001 Hirata et al. ..... 525/404
6,277,629 B1 * 8/2001 Wolf et al. ..... 435/288.3
6,315,767 B1 * 11/2001 Dumont et al. ..... 604/404
6,329,139 B1 * 12/2001 Nova et al. ..... 506/30
6,432,697 B1 * 8/2002 Tice et al. ..... 435/288.1
6,655,655 B1 * 12/2003 Matkovich et al. ..... 251/149.1
6,730,471 B1 * 5/2004 Katerkamp et al. ..... 435/4
6,923,567 B2 * 8/2005 Bibbo et al. ..... 366/149
7,104,074 B2 * 9/2006 Voute et al. ..... 62/62
7,357,567 B2 * 4/2008 Terentiev ..... 366/273
7,384,027 B2 * 6/2008 Terentiev et al. ..... 261/93
7,603,921 B2 * 10/2009 Baumfalk et al. ..... 73/866.5
7,629,167 B2 * 12/2009 Hodge et al. ..... 435/289.1
7,674,254 B2 * 3/2010 Baumfalk et al. ..... 604/533
7,832,922 B2 * 11/2010 Schoeb ..... 366/273
7,924,169 B2 * 4/2011 Baumfalk et al.
2002/0025547 A1 * 2/2002 Rao ..... 435/40.5
2002/0031822 A1 * 3/2002 van der Wel et al. ..... 435/289.1
2003/0198406 A1 * 10/2003 Bibbo et al. ..... 383/41
2004/0008570 A1 * 1/2004 Folestad et al. ..... 366/142
2004/0190372 A1 * 9/2004 Goodwin et al. ..... 366/273
2005/0158851 A1 * 7/2005 Furey ..... 435/289.1
2005/0163667 A1 * 7/2005 Krause ..... 422/102
2005/0239198 A1 * 10/2005 Kunas et al. ..... 435/297.1
2005/0239199 A1 * 10/2005 Kunas et al. ..... 435/297.1
2006/0051874 A1 * 3/2006 Reed et al. ..... 436/163
2006/0131765 A1 * 6/2006 Terentiev et al. ..... 261/93
2007/0157748 A1 * 7/2007 Baumfalk et al. ..... 73/866.5
2007/0159920 A1 * 7/2007 Baumfalk et al. ..... 366/152.4
2007/0185472 A1 * 8/2007 Baumfalk et al. ..... 604/533
2007/0253288 A1 * 11/2007 Mennenga et al. ..... 366/274
2007/0292940 A1 * 12/2007 Roll ..... 435/288.7
2009/0075362 A1 * 3/2009 Baumfalk et al. ..... 435/289.1
2009/0139298 A1 * 6/2009 Klees et al. ..... 73/1.03
2009/0147617 A1 * 6/2009 Baumfalk et al. ..... 366/152.1
2009/0207689 A1 * 8/2009 Artusi ..... 366/140
2009/0219780 A1 * 9/2009 Castillo et al. ..... 366/132
2010/0000348 A1 * 1/2010 Baumfalk et al.
2010/0015696 A1 * 1/2010 Claes et al. ..... 435/303.3
2011/0013473 A1 * 1/2011 Ludwig et al.
2011/0013474 A1 * 1/2011 Ludwig et al. ..... 366/102
2011/0038222 A1 * 2/2011 Ludwig et al.

FOREIGN PATENT DOCUMENTS

DE 3700622 A1 * 6/1988
EP 0151285 A2 * 8/1985
EP 0517151 A2 * 12/1992
EP 1473358 A2 * 11/2004
FR 2279449 A1 * 2/1976
WO WO 9630118 A1 * 10/1996
WO WO 2005068059 A1 * 7/2005
WO WO 2005115601 A1 * 12/2005

* cited by examiner

DISPOSABLE CONTAINER HAVING SENSOR MOUNTS SEALED TO THE CONTAINER AND SENSORS IN THE SENSOR MOUNTS FOR MEASURING AT LEAST ONE PARAMETER OF MEDIA IN THE CONTAINER

BACKGROUND OF THE INVENTION

1. Field of the Invention

The invention relates to a container for the mixing of media, in particular as a disposable container, which has at least one closable opening for the introduction and/or removal of the media and has a first sensor for measurement of at least one parameter of the mixture.

The subject invention also relates to a method for the mixing of media in a container, in particular a disposable container, in which at least one medium is introduced and mixed with at least one further medium, in which case parameters of the mixture can be measured by means of a sensor.

2. Description of the Related Art

In the pharmaceutical/biotechnological industry, sterile liquids have not only to be placed in different containers, transported and stored in widely differing applications, but also have to be manipulated. This includes, for example, mixing processes in which liquid or solid media must be added to the sterile liquids, and must be mixed with one another in a controlled manner. In addition, this also has to be done in sterile conditions.

Typical applications in this case are "virus deactivation" or the use of buffers. In the "virus deactivation" application the aim is to deactivate viruses which may be present in pharmaceutical/biotechnological sterile products (sterile liquids in the process scale>10 1) by means of a massive change in the pH value. For this purpose, a pH-changing solution or solid is added to the sterile product until a defined pH value is reached.

Sterile buffers are an important medium, for example for chromatography, as separation processes in the pharmaceutical/biotechnological industry. These buffers are produced by the addition of solids or liquid solutions to very pure sterile water, followed by a mixing process. In this case, one relevant criterion is also that the buffers be in sterile form, since processes are frequently chosen in which the buffers are produced from stock and therefore have to be stored for days or weeks.

Since the examples referred to for applications in the pharmaceutical/biotechnological industry relate to conventional validated processes, which require continuous checking of the state of the liquids and of the process steps, it is necessary to measure the process variables, such as the temperature or pH value of the sterile liquids.

It is known for steel or glass containers to be used which can be sterilized for the abovementioned processes, into which conventional measurement techniques (pH electrodes) or mixing techniques (stirrers) are introduced. This not only results in high investment costs (stainless steel containers, sterile technology, etc.) but also in high process costs as well as tedious processes (validated sterilizations by steam, etc.). The storage of sterile liquids in particular cannot be implemented using this technique, both as a result of sales, aspects and because of the space required.

WO 2005/068059 A1 discloses a container for the mixing of media, which has at least one closable opening, for the introduction and/or removal of the media. Furthermore, the known mixing bag has a sensor for the measurement of a parameter of the mixing process, as well as a stirrer. The mixing bag can in this case be made available to the user in an already sterilized form.

This known mixing bag has the disadvantage of inadequate adaptation to measurement and control processes. In particular, flows with different turbulences occur in flexible mixing bags such as these—even when using a stirrer which is arranged in the bag—which leads to different degrees of mixing, at least at times. When a sensor is used, this can lead to incorrect measurements or, because of the different flows in different area elements, to undesirable exceeding of an intended value, at least at times.

One object of the present invention is thus to improve the known mixing containers such that monitored mixing can be carried out as far as possible without additionally exceeding the intended values or other predetermined values. A further aim is to achieve this at as low a cost as possible.

SUMMARY OF THE INVENTION

This object is achieved in conjunction with a container for the mixing of media, in particular as a disposable container which has at least one closable opening for the introduction and/or removal of the media, and has a first sensor for measurement of at least one parameter of the mixture, and which is characterized in that at least one second sensor for measurement of the same parameter is arranged at a distance from the first sensor.

The arrangement of a second sensor, which is arranged at a first distance from the first sensor, allows the parameter to be measured to be measured at two different points so that different flow patterns can be detected better. In addition, comparison of the two measured values makes it possible to determine whether good mixing is taking place.

The container advantageously can be in the form of a sterilized, flexible bag. The container can thus be delivered as a sterilized bag in a sterile package, with the sensors already being arranged in the bag on delivery, and likewise being sterilized. There is therefore no need for the user to carry out a sterilization process. The containers, according to the invention, can also be used as bioreactors or fermenters, and then in the form of flexible bags, in particular as disposable apparatuses (disposable bioreactors).

According to one preferred embodiment of the invention, the first of the at least two sensors is located in the area of one third of the container which is located furthest away from the opening for the introduction of the media, and the second sensor is located in the area of one third of the container in which the opening for introduction of the media is located.

The arrangement of the sensors in different areas further improves the confidence relating to the different flow areas and mixing areas.

According to a further preferred embodiment of the invention, a third or further sensors for measurement of the same parameter is or are arranged at a distance from the first sensor and the second sensor.

This arrangement further improves the confidence of measurement in differently mixed areas of the container. Furthermore, this also improves the accuracy and resolution.

According to a further preferred embodiment of the invention, a greater number of sensors are arranged in areas in which flow with little turbulence can be expected during correct use than in areas in which the flow can be expected to be highly turbulent.

Better and faster mixing can be expected in areas in which there is strong flow turbulence than in areas in which there is little flow turbulence. Fewer sensors are therefore required in those areas in which there is strong flow turbulence and good mixing, in comparison to the other areas. The different flow areas can expediently be determined in appropriate trials, depending on the intended application.

According to a further preferred embodiment of the invention, sensors are provided for measurement of the pH value and/or of the conductivity and/or of the temperature. Alternatively, other parameters can also be measured by means of appropriate sensors.

According to a further preferred embodiment of the invention, the sensors are attached to the container wall via a sensor mount which rests at least with a rearward surface element or rear surface which faces away from the sensor on the inner wall of the container wall.

The arrangement of the sensor mounts or parts of them on the inner surface ensures that the sterility in the interior of the container is not adversely affected when the sensors are connected. The use of a sensor mount ensures a simple, reliable connection to the bag wall.

According to a further preferred embodiment of the invention, the sensor mount has a central piece which is passed through an opening in the container wall and is fixed to the container wall by a clamping part which can be connected to the central piece, with the container wall being clamped between a rearward surface element of the sensor mount and on a contact surface of the clamping part which faces an outer wall of the container, and with the rearward surface element resting against the inner wall of the container wall forming a seal.

Since the container wall is clamped between the sensor mount and the clamping part and the rearward area element rests on the inner wall of the container wall, this results in a sealed and reliable connection between the sensor mount and the container wall. The sterility in the container is not adversely affected in this way and there is no need for any adhesives whatsoever between the container wall and the sensor mount.

According to one preferred embodiment of the invention, the clamping part can be latched to the central piece.

Since the central piece and the clamping part can be latched to one another, the apparatus can be installed easily and at low cost.

According to a further preferred embodiment of the invention, the clamping part can be screwed to the central piece.

Screwing the clamping part to the central piece likewise results in a simple and reliable connection between the apparatus and the container wall. Furthermore a screw connection makes it possible to compensate more easily for any tolerances between the parts which are connected to one another.

According to a further preferred embodiment of the invention, the rearward surface element has one or more clamping projections which engage in the container wall transversely with respect to the container wall.

The clamping projections which engage in the container wall ensure that the container wall cannot be pulled out of the clamp connection at the side.

According to a further preferred embodiment of the invention, the contact surface of the clamping part has one or more clamping projections which engage in the container wall transversely with respect to the container wall. In particular, the clamping projections are in the form of annular webs for the screw connection of the clamping part. The clamping projections on the sensor mount and on the clamping part are matched to one another and, for example, are arranged offset with respect to one another.

According to a further preferred embodiment of the invention, an electrical or optical connection from the sensor to sensor electronics outside the container is passed through the central piece of the sensor mount.

In this case, the electrical or optical connection can be arranged reliably in the central piece. For example, it can be encapsulated together with the sensor in the central piece or the sensor mount. It is also possible to arrange an electrical or optical coupling on the central piece.

According to a further preferred embodiment of the invention, the sensor mount has an electronic or optical transmitting unit which is connected to the sensor, in which case the transmitting unit communicates without the use of wires with a receiving unit which is arranged outside the container.

The transmitting unit in the sensor mount means that there is no need for any aperture in the container wall. All that is then required outside the container is an appropriate receiving unit for communication without the use of wires which can once again be designed to be reusable. In principle, the sensor mount can in this case be welded to the container wall without any problems, since any sealing problems on the weld bead are irrelevant in this case.

According to one preferred embodiment of the invention, the sensor mount has a central piece on its rear surface, which central piece is surrounded in an interlocking manner by a bulge on the container wall.

The bulge on the central piece, which is surrounded by a corresponding bulge on the container wall in an interlocking manner, means that there is no need for welding or adhesive bonding. However, in principle, it is also sufficient for the central piece to be inserted into a bulge in the container wall and to be fixed by means of a clamping ring which is fitted from the outside and may have the necessary receiving unit.

The known methods for the mixing of media, in particular in disposable containers, have the abovementioned disadvantages.

A further object of the present invention is thus to improve the known methods such that controlled mixing is possible even in disposable containers, such as mixing bags, while in particular also avoiding individual parameters exceeding predetermined intended values in specific areas, at times.

This object is achieved in conjunction with the subject method for the mixing of media in a preferably disposable container in which at least one medium is introduced and mixed with at least one further medium, in which case parameters of the mixture can be measured by means of a sensor, in that the following steps are provided:

a) introduction of the at least one medium into the container, b) introduction of the further medium into the bag while at the same time mixing the media in the container to form a mixture, c) measurement of values of at least one identical parameter of the mixture by means of at least two sensors which are separated from one another, d) comparison of the values measured in step c) with an intended value, which is preselected for that mixture, of the identical parameter, e) interruption of the introduction of the further medium in step b) with the mixing process being continued, when the comparison in step d) shows that one of the measured values corresponds at least to the preselected intended value, f) repetition of steps c) and d), g) continuation of the introduction of the further medium in accordance with step b) if the comparison in step d) shows that all of the measured values are below the preselected intended value, and h) ending of step b) when the comparison in step d) shows that all of the measured values correspond to the preselected intended value.

Since the parameter to be measured is measured using at least two sensors at different points, it is possible to detect whether the medium has still not been uniformly mixed. At the same time, this makes it possible largely to avoid the risk of exceeding a preselected intended value in surface elements of the container. This considerably improves the adaptation to measurement and control processes even when using disposable containers and flexible bags.

According to a further embodiment of the invention, in step e) set forth above the introduction process is interrupted only when the comparison in step d) shows that one of the measured values has reached a permissible difference magnitude which is above the preselected intended value.

It is thus possible to allow the intended value to be briefly overshot by a predetermined value or difference magnitude.

Further details of the invention will become evident from the following detailed description and from the attached drawings, which illustrate preferred embodiments of the invention by way of example.

DETAILED DESCRIPTION OF THE PREFERRED EMBODIMENTS

Figure 1:
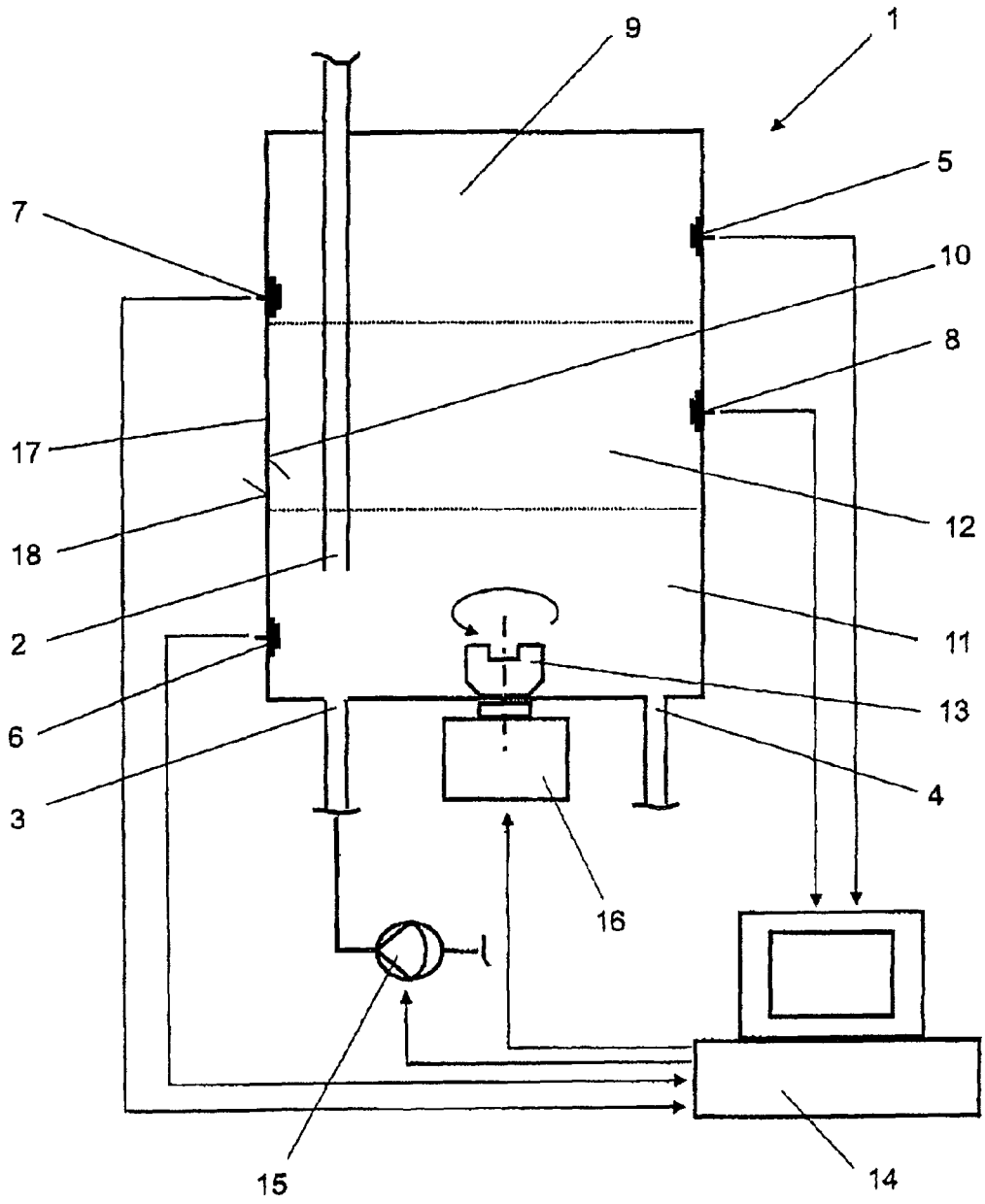
FIG. 1 shows a schematic illustration of a flexible disposable container with sensors and with a process control device.

Turning to FIG. 1, a container 1 for the mixing of media essentially comprises openings 2, 3, 4 which can be closed for the introduction and/or removal of media, and sensors 5, 6, 7, 8 for measurement of one parameter of the mixing process.

The container 1 is in the form of a flexible bag which is or can be sterilized and, in a manner known per se, has the first opening 2 through which, for example, a product solution can be supplied as a medium, the second opening 3 through which, for example, a substance which changes the pH value can be supplied as a further medium, and the third opening 4 through which, for example, the mixture can be emitted. All of the openings are provided with flexible tube connections, which can be closed but are not illustrated in any more detail. The openings can end in the container wall 17 or can project into the interior of the container as illustrated in the case of the opening 2.

The first sensor 5 is arranged on an inner surface 10 of the container wall 17 of the container 1 and, in the exemplary embodiment, is located in the upper third 9 of the container 1, while the openings 2, 3, 4 are located in the lower third 11 of the container 1. The second sensor 6 is arranged on the inner wall 10 of the container 1 in the lower third 11 of the container 1. The third sensor 7 is located in the upper third 9 and the fourth sensor 8 is located in the central third 12 of the container 1. A stirrer 13 is located in the lower third 11 in order to stir the mixture and is driven by an external stirring apparatus. In the exemplary embodiment, a strongly turbulent flow can be expected through the second opening 3 which is used as a supply opening, and through the stirrer 13, as a result of the mixing process, while a flow with little turbulence can be expected in the upper third 9 which is further away. Mixing takes place more slowly in regions in which there is little turbulent flow, so that a plurality of sensors 5, 7, 8 are arranged here.

The sensors 5, 6, 7, 8 are connected to a data recorder and/or to a control unit 14. By way of example, a membrane pump 15 for supplying the medium which varies the pH value is controlled via the control unit 14. The stirrer 13 and/or the stirring apparatus 16 are/is likewise controlled by the control unit 14.

According to further exemplary embodiments as shown in FIGS. 3-8, the sensors 5, 5' are attached via the sensor mounts 511, 512, 513, 514, 515, 516 to the containers with a flexible container wall 17. The sensor mounts 511, 512, 513, 514, 515, 516 have the sensor 5, 5' in the area of their front surfaces 517. The rearward surface element 518 or rear surface 519, facing away from the front surface 517 of the sensor mounts 511, 512, 513, 514, 515, 516 rest on an inner wall 10 of the container wall 17.

In the area of their rearward surface element 518, the sensor mounts 511, 512, 513, 514 each have a central piece 521, 510 which is passed through an opening 522 in the container wall 17 and is connected to a clamping part 523, 524, 525. The clamping part 523, 524, 525 has a contact surface 526 by means of which it rests on an outer wall 18, facing away from the inner wall 10, of the container wall 17, so that the container wall 17 is clamped in between the rearward surface element 518 and the contact surface 526, and the contact surface 526 rests on the inner wall 10, forming a seal.

Figure 3:
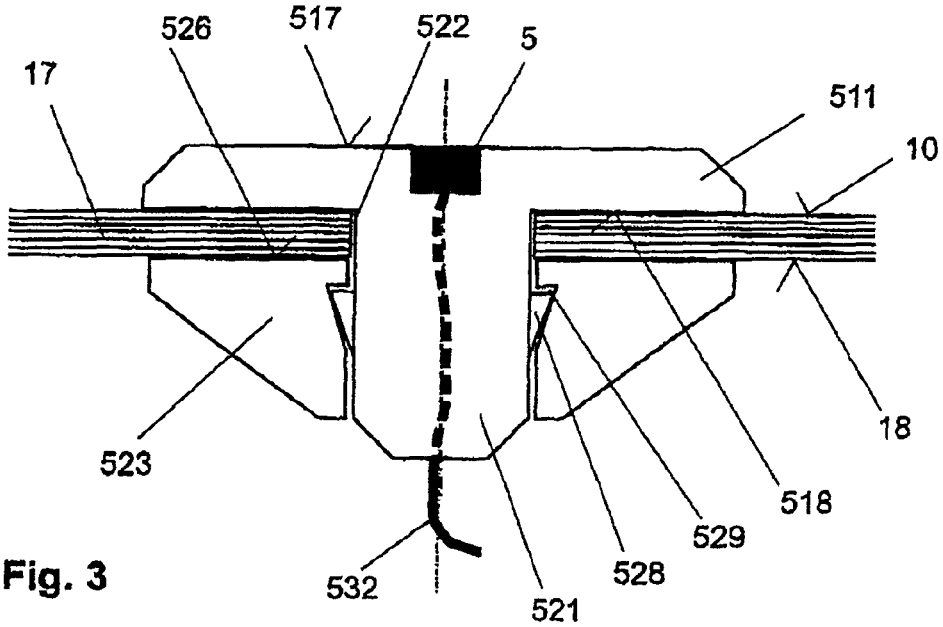
FIG. 3 shows a side view of a sensor mount for attachment of a sensor, in which a clamping part can be latched to a central piece, in the form of a section.
Figure 5:
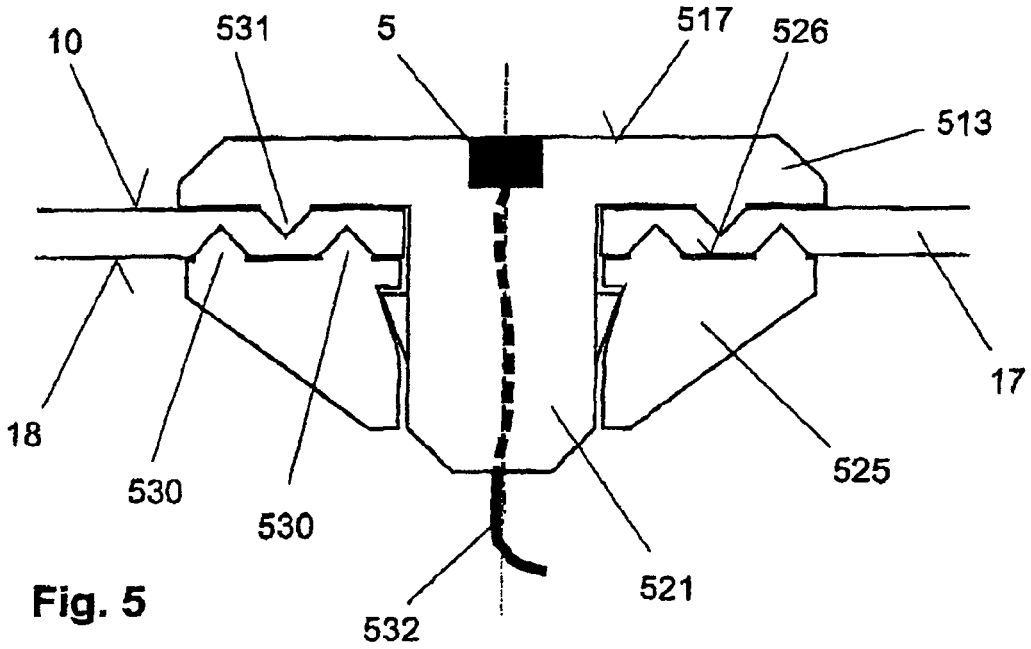
FIG. 5 shows a side view of a sensor mount for attachment of a sensor, in which the clamping part and the central piece can be latched and have clamping projections.
Figure 6:
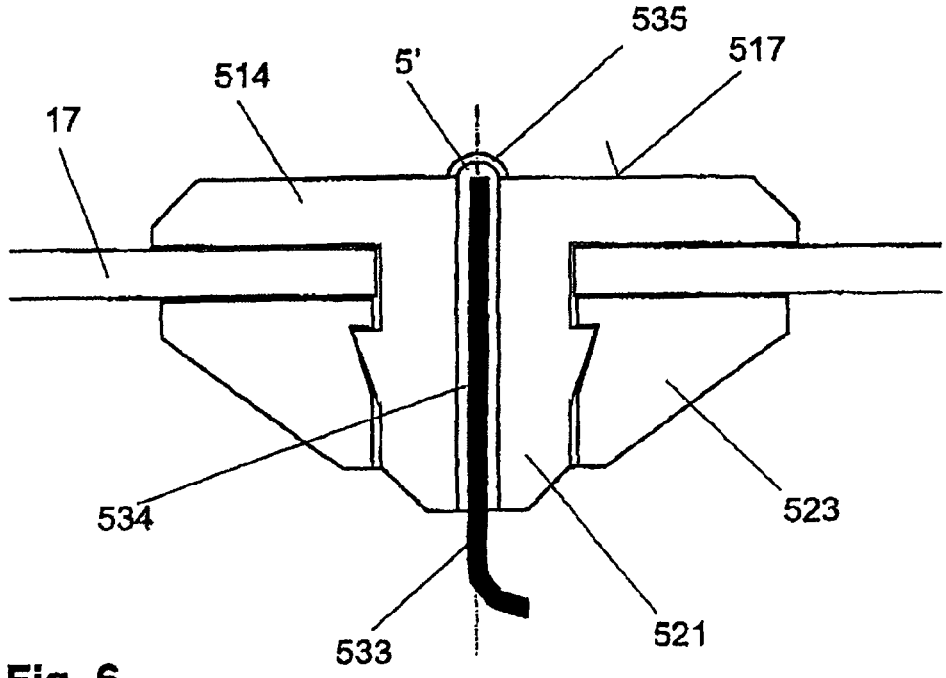
FIG. 6 shows a side view of a sensor mount for attachment of a sensor having an optical sensor and an optical signal line, in the form of a section.

As shown in the embodiments in FIG. 3 and FIG. 6, the clamping part 523 can be latched to the central piece 521 and, as shown in FIG. 5, the clamping part 525 can be latched to the central piece 521. The central piece 521 of the sensor mounts 511, 513 and 514 for this purpose in each case has a circumferential latching tab 528, which latches in a circumferential latching groove 529 in the clamping parts 523, 525.

Figure 4:
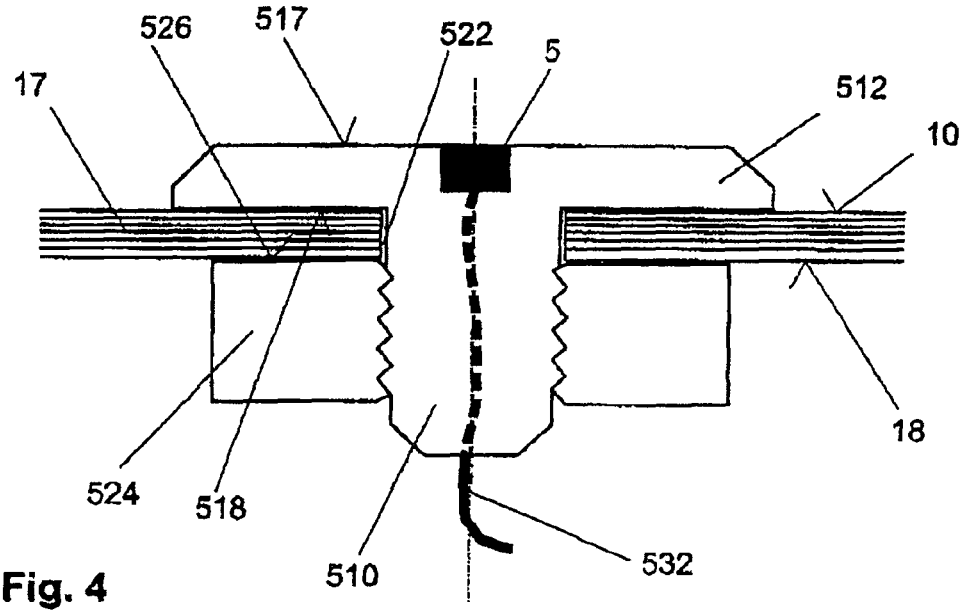
FIG. 4 shows a side view of a sensor mount for attachment of a sensor, in which a clamping part can be screwed to a central piece, in the form of a section.

According to one embodiment, shown in FIG. 4, the clamping part 524 can be screwed to the central piece 510 of the sensor mount 512.

According to another embodiment, shown in FIG. 5, the clamping part 525 has on its contact surface 526 two clamping projections 530 in the form of annular webs and, on its rearward surface element 518, the sensor mount 513 has a clamping projection 531 in the form of an annular web. The clamping projection 531 on the sensor mount 513 is in this case arranged on a diameter which is between the diameters of the two clamping projections 530 on the clamping part 525. The sensor 5 is embedded in the sensor mounts 511, 512, 513, 515 and 516. As can be seen from FIGS. 3, 4, 5 the sensor 5 is connected to sensor electronics and/or to the control unit 14 via an electrical connection 532 which is passed through the central piece 521.

As can be seen from the exemplary embodiment in FIG. 6, an optical sensor 5' is formed by one end of an optical waveguide which is connected as an optical connection 533 to sensor electronics and/or to a control unit. The optical connection 533 is guided in a central hole 534 in the central piece 521 of the sensor mount 514. In the area of the front surface 517 of the sensor mount 514, the central hole 534 is covered by a transparent cover 535, forming a seal. The transparent cover 535 may in this case act as the actual sensor, connected to a corresponding coating.

Figure 7:
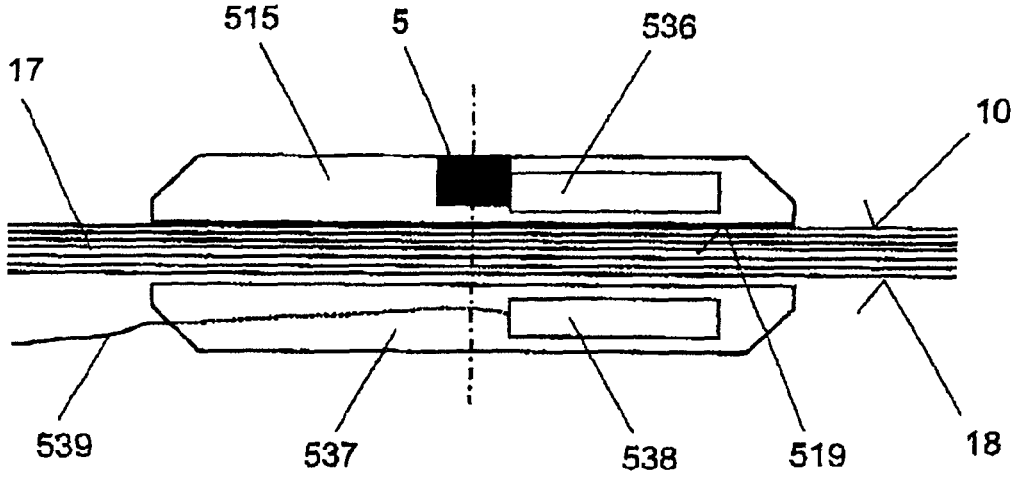
FIG. 7 shows a side view of a sensor mount for attachment of a sensor, which has a transmitting unit which is connected to the sensor, in the form of a section.

As can be seen from an embodiment shown in FIG. 7, the rear surface 519, facing away from the sensor 5, of the sensor mount 515 rests on the inner wall 10 of the flexible container wall 17. The sensor mount 515 is fixed to the container wall 17 by welding. The sensor 5 which is embedded in the sensor mount 515 is in this case connected to a transmitting unit 536 which is likewise embedded in the sensor mount 515 and also can be in the form of a transmitting/receiving unit. A receiving part 537 with a receiving unit 538 which can communicate with the transmitting unit 536 on the sensor mount 515 can be placed outside the container wall 17 or the container 1. The receiving unit 538 can likewise be in the form of a transmitting/receiving unit. The receiving unit 538 or transmitting/receiving unit is then connected to sensor electronics and/or to the control unit via an electrical connection 539.

Figure 8:
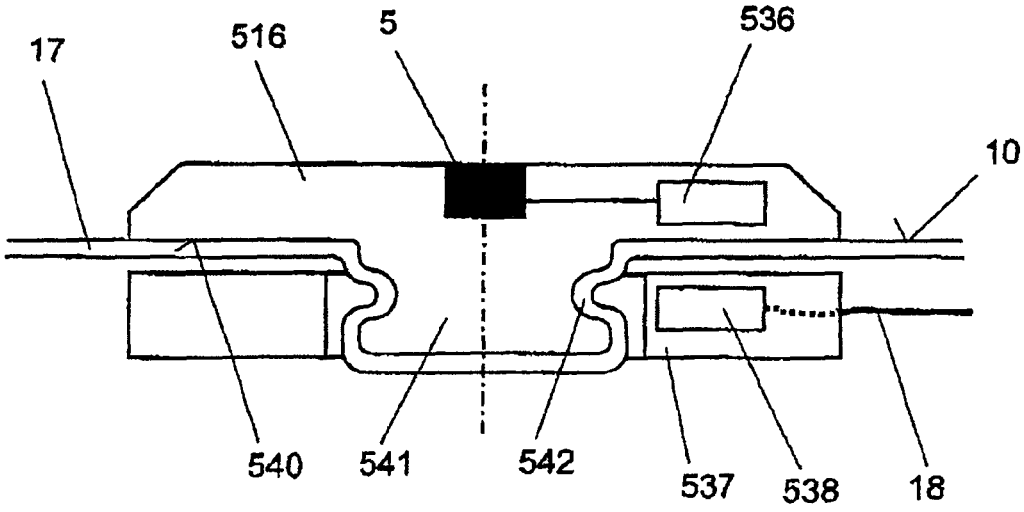
FIG. 8 shows a side view of a further sensor mount for attachment of a sensor having a sensor mount which has a transmitting unit which is connected to the sensor and whose central piece is surrounded in an interlocking manner by a bulge on the container wall.

According to the embodiment shown in FIG. 8, the sensor mount 516 has a central piece by 41 on its rear surface 540 and this central piece by 41 is surrounded in an interlocking manner by a bolt 542 on the container wall 17. In the embodiments illustrated in FIGS. 3-8, the sensor or mounts each have a rearward surface element 518 resting against the inner surface 10 of the vessel wall and forming a seal. The sensors 5, 6, 7, 8 are embedded in a surface of the respective sensor mount facing away from the rearward surface element 518 of the sensor mount, whereby the seal between the reward surface element 518 and the inner surface 10 of the vessel wall 17 ensures sterility in the interior of the container.

The procedure for a process controlled with the aid of the apparatus according to the invention will be described by way of example for "virus deactivation".

Previous process steps by the user have produced an aqueous product solution which, in addition to the product, can also contain viruses. One of a plurality of conventional steps for virus removal/reduction is to change the pH value of the solution by the addition of solid or liquid substances which influence the pH value. One important process variable in this context is the control of the minimum required pH value throughout the entire volume, that is to say ensuring homogeneity of the pH value is of critical importance for the process.

Figure 2:
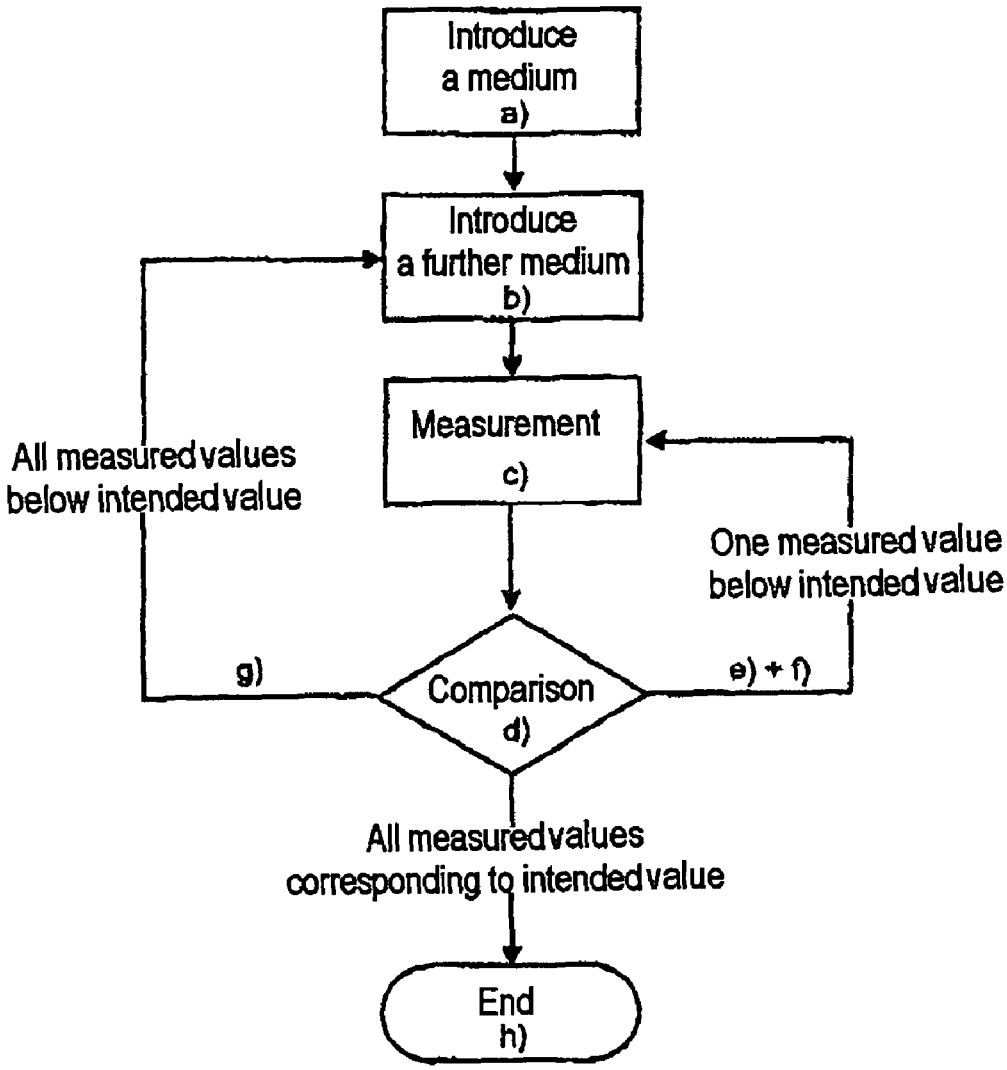
FIG. 2 shows a flowchart of a mixing process.

The following procedure (see FIG. 2) has been carried out:

1. The disposable container 1 is filled, in a sterile form for further treatment, with a product solution from a sterile process step (for example, fermenter).

2. The sensors 4, 5, 6, 7 as well as the stirrer 13 are connected to the electronics and/or to the control unit 14.

3. The stirring process is started, and the actual state of the parameter—such as the pH value—is recorded by means of a check and adjustment of the sensors 5, 6, 7, 8. The temperature can additionally be recorded, by means of a temperature sensor which is not illustrated.

4. By inclusion in a higher-level process-controlled technique used by the control unit 14, the sensors 5, 6, 7, 8 together with a predetermined control algorithm, with the stirring apparatus 16 and with controlled supply of the solutions to be added in (membrane pump 15) form a control loop for control of the pH value and other variables.

5. The substance which changes the pH value is added to the product solution in a controlled manner. In the example, this is subject to the constraint that the pH value is not subject to any major fluctuations locally (and this is checked by matching the sensors 5, 6, 7, 8 to one another) and the nominal or intended value is not exceeded, with this being ensured by means of a suitable control algorithm.

6. After completion of the supply process, via the second opening 3, the mixing/stirring process is continued until a homogeneous pH intended value is ensured by matching of all of the sensors 5, 6, 7, 8.

While the invention has been described with respect to preferred embodiments, it is apparent that various changes can be made without departing from the scope of the invention as defined by the appended claims.

What is claimed is:

1. A disposable container for the mixing of media comprising a flexible mixing vessel (1) having a vessel wall (17) with an inner surface (10) facing into an interior of the vessel (1)and at least one stirrer within the vessel (1), the vessel (1) having at least one closable opening (2, 3, 4) for introduction and/or removal of the media directly into an open, main body portion of the vessel (1), a first sensor (5) for measurement of at least one parameter of the mixture, and at least one second sensor (6) for measurement of the same parameter arranged at a distance from the first sensor (5), the first sensor (5) being located in an area of one third (9) of the vessel (1) which is located furthest away from the opening (3) for the introduction of the media, and the second sensor (6) is located in an area of one third (11) of the vessel (1) in which the opening (3) for introduction of the media is located for measurement and comparison of the parameter at more than one location of the vessel (1), and further characterized in that each of the sensors (5, 5') is attached to the inner surface (10) of the vessel wall (17) via a sensor mount (511, 513, 514), the sensor mount (511, 513, 514) having a rearward surface element (518) resting against the inner surface (10) of the vessel wall (17) and forming a seal, the sensors (5, 6, 7, 8) being embedded in a surface of the sensor mount (511, 513, 514) facing away from the rearward surface element (518) whereby the seal between the rearward surface element (518) and the inner surface (10) of the vessel wall (17) ensures sterility in the interior of the container.

2. The disposable container according to claim 1, characterized in that the vessel (1) is in the form of a sterilized, flexible bag.

3. The disposable container according to claim 1, characterized in that a third (7) or further sensors (8) for measurement of the same parameter is or are arranged at a distance from the first sensor (5) and the second sensor (6).

4. The disposable container according to claim 3, characterized in that one (6) of the sensors (5, 6, 7, 8) is arranged in the area of that third (11) of the container (1) in which a stirrer (13) is arranged, and at least one of the sensors (5, 7) is arranged in the area of that third (9) of the vessel (1) which is furthest away from the stirrer (13).

5. The disposable container according to claim 4, characterized in that one (8) of the sensors (5, 6, 7, 8) is arranged in a central third (12) of the vessel (1).

6. The disposable container according to claim 5, characterized in that a greater number of sensors (5, 7, 8) are arranged in areas in which flow with little turbulence can be expected during correct use than in areas in which the flow can be expected to be highly turbulent.

7. The disposable container according to claim 6, characterized in that sensors (5, 6, 7, 8) are provided at least for measurement of the pH value and/or of the conductivity and/or of the temperature.

8. The disposable container according to claim 1, characterized in that the sensor mount (511, 512, 513, 514) has a central piece (510, 521) which is passed through an opening (522) in the inner vessel wall (17) and is fixed to the inner vessel wall (17) by a clamping part (523, 524, 525) which can be connected to the central piece (510, 521), with the inner vessel wall (17) being clamped between a rearward surface element (518) of the sensor mount (511, 512, 513, 514) and on a contact surface (526) of the clamping part (523, 524, 525) which faces an outer surface (18) of the vessel wall (17) of the vessel (1), and in that the rearward surface element (518) rests against the inner surface (10) of the vessel wall (17) forming a seal.

9. The disposable container according to claim 8, characterized in that the clamping part (523, 525) has a circumferential locking groove (529) that can be latched to the central piece (521).

10. The disposable container according to claim 9, characterized in that the rearward surface element (518) has one or more clamping projections (531) which engage in the inner vessel wall (17) transversely with respect to the inner vessel wall (17).

11. The disposable container according to claim 10, characterized in that the contact surface (526) of the clamping part (525) has one or more clamping projections (530) which engage in the inner vessel wall (17) transversely with respect to the inner vessel wall (17).

12. The disposable container according to claim 11, characterized in that the clamping projections (530, 531) on the sensor mount (513) and on the clamping part (525) are matched to one another.

13. The disposable container according to claim 10, characterized in that the clamping projections (530, 531) are in the form of annular webs.

14. The disposable container according to claim 10, characterized in that an electrical (533) or optical (532) connection from the sensor (5, 5') to sensor electronics or a control unit (14) outside the vessel (1) is passed through the central piece (510, 521) of the sensor mount (511, 512, 513, 514).

15. The disposable container according to claim 8, characterized in that the clamping part (524) can be screwed to the central piece (510).

16. The disposable container according to claim 1, characterized in that the sensor mount (515, 516) has an electronic or optical transmitting unit (536) which is connected to the sensor (5'), and in that the transmitting unit (536) communicates without the use of wires with a receiving unit (538) which is arranged outside the vessel (1).

17. The disposable container according to claim 16, characterized in that the sensor mount (516) has a central piece (541) on its rear surface (519), which central piece (541) is surrounded in an interlocking manner by a bulge (542) on the inner vessel wall (17).

18. The disposable container according to claim 1, characterized in that the first sensor (5) and second sensor (6) are located on the inner surface (10) of the vessel wall (17) distanced from the closable openings (2, 3, 4) for the introduction and/or removal of the media.

19. The disposable container according to claim 1, characterized in that the at least one closable opening (2, 3, 4) for the introduction and/or removal of the media is located in the lower one third of the vessel (1) and passes through the vessel wall (17).

* * * * *